United States Patent [19]

Takahashi

[11] 4,021,612

[45] May 3, 1977

[54] DECODER APPARATUS APPLICABLE TO MATRIX 4-CHANNEL SYSTEMS OF DIFFERENT TYPES

[75] Inventor: Susumu Takahashi, Tokyo, Japan

[73] Assignee: Sansui Electric Co., Ltd., Tokyo, Japan

[22] Filed: Nov. 4, 1975

[21] Appl. No.: 628,831

[30] Foreign Application Priority Data

Nov. 7, 1974 Japan ..... 49-128324

[52] U.S. Cl. ..... 179/1 GQ

[51] Int. Cl.[2] ..... H04R 5/00

[58] Field of Search ..... 179/1 GQ, 1 G, 1 VL, 179/15 BT, 100.1 TD, 100.4 ST; 328/258

[56] References Cited

UNITED STATES PATENTS

| | | | |
|---|---|---|---|
| 3,691,298 | 9/1972 | Pittman et al. | 179/1 VL |
| 3,783,192 | 1/1974 | Takahashi | 179/1 GQ |
| 3,825,684 | 7/1974 | Ito et al. | 179/1 GQ |
| 3,836,715 | 9/1974 | Ito et al. | 179/1 GQ |
| 3,887,770 | 6/1975 | Takahashi | 179/1 GQ |
| 3,934,086 | 1/1976 | Takahashi | 179/1 GQ |

*Primary Examiner*—Douglas W. Olms

*Attorney, Agent, or Firm*—Harris, Kern, Wallen & Tinsley

[57] ABSTRACT

This invention discloses a control circuit to be used in a decoder apparatus applicable to matrix 4-channel systems of different types. The control circuit is adapted to control, according to the type of composite signals to be decoded by the decoder apparatus, at least first and second gain control amplifiers which control the amplitude ratio between signals to be combined into output signals, and includes an FET array comprised of at least four field effect transistors formed in a semiconductor chip. First and second field effect transistors in the FET array are so connected to a DC power source that different predetermined DC currents may flow through their source-drain paths. To the first and second gain control amplifiers, third and fourth field effect transistors of the FET array are coupled respectively in such a manner that the internal resistances between their source-drain paths control the gains of the first and second amplifiers. The third and fourth field effect transistors are supplied with DC bias volates produced by either the first field effect transistor or the second field effect transistor, selectively in accordance with the type of the composite signals to be decoded.

3 Claims, 7 Drawing Figures

DECODER APPARATUS APPLICABLE TO MATRIX 4-CHANNEL SYSTEMS OF DIFFERENT TYPES

This invention relates to a decoder for matrix 4-channel system.

Typical matrix 4-channel systems are RM(QS) system and SQ system. Encoded composite signals by these two systems are decoded and reproduced usually be different decoders suitable for the respective systems. If two decoders are used to decode the composite signals of different systems, however, a reproducing apparatus becomes complicated and uneconomical. It is therefore desired to decode and reproduce the composite signals of both the RM(QS) and SQ systems, commonly using most of the circuit structure. To satisfy this requirement such a decoder as shown in FIG. 1 has been proposed.

In the decoder of FIG. 1, 2-channel composite signals $L_T$ and $R_T$ are supplied respectively through reference phase shifters ($\phi \pm 0°$) 11 and 12 having the same phase shifting characteristic to a first matrix circuit 13 and a second matrix circuit 14, thus producing a sum signal $L_T+R_T$ and a difference signal $L_T-R_T$. The sum signal $L_T+R_T$ is supplied directly to, and the difference signal $L_T-R_T$ is supplied through a gain control amplifier 16 of gain f to, a third matrix circuit 15. By the third matrix circuit 15 signals $\frac{1}{2}[(L_T+R_T)+f(L_T-R_T)]$ and $\frac{1}{2}[(L_T+R_T)-f(L_T-R_T)]$ are produced. These signals are supplied respectively to phase shifters ($\theta \pm 0°$) 17 and 18 having the same phase shifting characteristic to produce a front-left reproduced signal LF′ and a front-right reproduced signal RF′, respectively.

The 2-channel composite signals $L_T$ and $R_T$ are also supplied respectively through the reference phase shifters ($\phi \pm 0°$) 11 and 12 to a fourth matrix circuit 19 and a fifth matrix circuit 20, thus producing difference signal $L_T-R_T$ and sum signal $L_T+R_T$. If the composite signals $L_T$ and $R_T$ to be decoded are based on the RM(QS) system, difference signal $L_T-R_T$ is supplied directly to, and sum signal $L_T+R_T$ is supplied through a switch $S_1$ and a second gain control amplifier 22 of gain b, to a sixth matrix circuit 21. There is further provided a seventh matrix circuit 23 which receives the 2-channel signals $L_T$ and $R_T$ and produces sum signal $L_T+R_T$, which is phase-shifted by a phase shifter ($\phi+90°$) with a phase shifting characteristic of +90° (+j) with respect to the reference phase shifters ($\phi \pm 0°$) 11 and 12 and then supplied in the form of $+j(L_T+R_T)$ to the second gain control amplifier 22 through the switch $S_1$ if the composite signals $L_T$ and $R_T$ to be decoded are based on the SQ system.

When the switch $S_1$ is thrown to the RM(QS) decoding position as shown, the sixth matrix circuit 21 receives the signal $L_T-R_T$ and the signal $b(L_T+R_T)$ and then produces a signal $\frac{1}{2}[(L_T-R_T)+b(L_T+R_T)]$ and a signal $\frac{1}{2}[(L_T-R_T)-b(L_T+R_T)]$. When the switch $S_1$ is thrown to the SQ decoding position, the sixth matrix circuit 21 receives the signal $L_T-R_T$ and the signal $+jb(L_T+R_T)$ and produces a signal $\frac{1}{2}[(L_T-R_T)+jb(L_T+R_T)]$ and a signal $\frac{1}{2}[(L_T-R_T)-jb(L_T+R_T)]$. The signals from the matrix circuit 21, that is, $\frac{1}{2}[(L_T-R_T)+b(L_T+R_T)]$ and $\frac{1}{2}[(L_T-R_T)-b(L_T+R_T)]$ or $\frac{1}{2}[(L_T-R_T)+jb(L_T+R_T)]$ and $\frac{1}{2}[(L_T-R_T)-jb(L_T+R_T)]$ are supplied respectively to phase shifters ($\theta-90°$) 25 and 26 having a phase shifting characteristic of −90° (−j) with respect to the phase shifters ($\theta \pm 0°$) 17 and 18 to produce a back-left reproduced signal LB′ and a back-right reproduced signal RB′ in the RM(QS) system or the SQ system.

The gain *f* of the first gain control amplifier 16 and the gain *b* of the second gain control amplifier 22 are controlled respectively by bias voltages applied from a bias power source 27 respectively through a switch $S_2$ and a switch $S_3$. The switches $S_1$, $S_2$ and $S_3$ are ganged with one another as shown by a dotted line. These switches are thrown to the decoding position for the RM(QS) system, the first gain control amplifier 16 and the second gain control amplifier 22 are supplied with such bias voltages from the bias power source 27 as set their gains *f* and *b* to about 0.4. When these switches are thrown to the decoding position for the SQ system, the gain control amplifiers 16 and 22 are supplied with such bias voltages from the bias power source 27 as set their gains *f* and *b* to about 1.0.

Namely, in the decoder as shown in FIG. 1 the decoding can be effected either in the RM(QS) system or in the SQ system by changing over the switches $S_1$, $S_2$ and $S_3$. The composite signals $L_T$ and $R_T$ of the RM(QS) system are respresented as follows if the 4-channel audio signals are denoted as LF, RF, LB and RB:

$$L_T = LF + 0.4RF + jLB + j0.4RB$$

$$R_T = RF + 0.4LF - jRB - j0.4LB.$$

Let 4-channel reproduced signals obtained by an ordinary RM(QS) decoder be denoted as LF′o, RF′o, LB′o and RB′o. Then the RM(QS) 4-channel reproduced signals LF′, RF′, LB′ and RB′ obtained by the decoder shown in FIG. 1 are represented as follows:

$$LF' = 0.72(L_T + 0.4R_T) = 0.72LF'o$$

$$RF' = 0.72(R_T + 0.4L_T) = 0.72RF'o$$

$$LB' = -j0.72(L_T - 0.4R_T) = 0.72LB'o$$

$$RB' = j0.72(R_T - 0.4L_T) = 0.72RB'o$$

This means that the decoder shown in FIG. 1 decodes the composite signals in the same way as the ordinary RM(QS) decoder.

In the SQ system, 2-channel composite signals $L_T$ and $R_T$ are represented as follows:

$$L_T = LF - j0.7LB + 0.7RB$$

$$R_T = RF + j0.7RB - 0.7LB$$

Let 4-channel reproduced signals obtained by an ordinary SQ decoder be denoted as LF′o, RF′o, LB′o and RB′o. Then the SQ 4-channel reproduced signals LF′, RF′, LB′ and RB′ obtained by the decoder shown in FIG. 1 are represented as follows:

$$LF' = L_T = LF'o$$

$$RF = R_T = RF'o$$

$$LB' = \tfrac{1}{2}(L_T + jR_T + R_T - jL_T)$$

$$= e^{-j\frac{3\pi}{4}} LB + 0.7e^{-j\frac{\pi}{4}} LF + 0.7e^{j\frac{\pi}{4}} RF$$

$$= e^{-j\frac{3\pi}{4}} (LB + j0.7LF - 0.7RF)$$

$$= e^{-j\frac{3\pi}{4}} LB'o$$

-continued $$RB' = \tfrac{1}{2}(-R_T - jL_T - L_T + jR_T)$$

$$= e^{-j\frac{3\pi}{4}} RB + 0.7e^{j\frac{3\pi}{4}} RF + 0.7e^{-j\frac{3\pi}{4}} LF$$

$$= e^{-j\frac{3\pi}{4}} (RB - j0.7RF + 0.7LF)$$

$$= e^{-j\frac{3\pi}{4}} RB'o.$$

Thus, front reproduced signals LF′ and RF′ become identical with reproduced signal LF′o and RF′o obtained by the ordinary SQ decoder. Back reproduced signals LB′ and RB′ have a phase different by $$e^{-\frac{3\pi}{4}} (-135°)$$

from that of reproduced signals LB′o and RB′o obtained by the ordinary SQ decoder, but they are the same as reproduced signals LB′o and RB′o in signal composition.

In the decoder illustrated in FIG. 1, the gain *f* of the first gain control amplifier 16 and the gain *b* of the second gain control amplifier 22 are set both at 0.4 or 1.0 in accordance with the type of composite signals $L_T$ and $R_T$ to be decoded.

However, the gains *f* and *b* may be varied in order to improve the channel separation in the following manner. An instantaneous amplitude relationship between the audio signals in the composite signals $L_T$ $R_T$ is detected in both the RM(QS) and SQ systems, thus obtaining control signals Ef and Eb. These control signals Ef and Eb are supplied to the first gain control amplifier 16 and the second gain control amplifier 22 to vary the gains *f* and *b*, respectively.

For the first gain control amplifier 16 or the second gain control amplifier 22, such a circuit as shown in FIG. 2 has been proposed. In FIG. 2, $Q_1$ denotes a transistor whose base is connected to receive the difference sign $L_T$–$R_T$ from the second matrix circuit 14. To the emitter of the transistor $Q_1$ is connected such a field effect transistor $Q_2$ as shown in FIG. 2 so that internal resistance of the transistor $Q_2$ controls the gain of the gain control amplifier 16. The source of the transistor $Q_2$ is applied through the switch $S_2$ with a voltage preset by a variable resistor $VR_1$ or $VR_2$ of the bias power source 27. When the switch $S_2$ is changed over, the source voltage Vs of the transistor $Q_2$ is varied, causing the gate-source voltage Vgs to change. Once the gate-source voltage Vgs has been changed, the internal resistance of the transistor $Q_2$ varies. If the above-mentioned control signal Ef is supplied to the gate of the field effect transistor $Q_2$, the internal resistance of the transistor $Q_2$ can be varied by the variation of control signal Ef. To make the explanation simple, however, it is assumed here that both signal Ef and signal Eb are constant and that the gate voltage Vg applied to the gate of the transistor $Q_2$ is constant, too.

Generally, the characteristics of the internal resistance Ron of field effect transistors A and B of the same type differ so greatly as indicated in FIG. 3 with respect to the gate-source voltage Vgs. For this reason, the gain of the gain control amplifier shown in FIG. 2 cannot be constant even if the gate-to-source voltage Vgs is made constant and thus the source voltage Vs is made constant. The gain of the gain control amplifier is inevitably changed to a considerable degree according to the value of the pinch-off voltage Vp (e.g. VpA, VpB in FIG. 3) or the threshold voltage $V_{TH}$ of each field effect transistor. Consequently, if gain control amplifiers as illustrated in FIG. 2 are employed to constitute such a decoder as shown in FIG. 1, the variable resistors $VR_1$ and $VR_2$ of the bias power source 27 should be adjusted independently in order to set the gain of each gain control amplifier at 0.4 in case of decoding for the RM(QS) system and at 1.0 in case of decoding for the SQ system. Thus, the adjustment of bias voltages is very complicated and time-consuming for setting the gains of the gain control amplifiers in a decoder.

Accordingly, it is the object of this invention to provide a control circuit of gain control amplifiers for use in a decoder apparatus applicable to different matrix 4-channel systems which is capable of easily setting the gains of the gain control amplifiers in accordance with the respective matrix 4-channel systems.

According to this invention there is provided a decoder apparatus applicable to matrix 4-channel systems of different types and adapted to produce a plurality of output signals by combining first and second composite signals to be decoded, said decoder apparatus comprising at least two gain control amplifiers each adapted to vary amplitude ratio between signals to be combined to produce each output signal in accordance with the type of said first and second composite signals to be decoded; and control circuit means for controlling the gains of said at least two gain control amplifiers in accordance with the type of said first and second composite signals to be decoded, characterized in that said control circuit means comprises an FET array comprised of at least first, second, third and fourth field effect transistors formed in a semiconductor chip, said first and second field effect transistors being coupled across a DC power source so that predetermined direct currents of different values flow through the source-drain paths of said first and second field effect transistors, and said third and fourth field effect transistors being AC coupled to said at least two gain control amplifiers, respectively, so that no direct current flows through the source-drain paths of said third and fourth field effect transistors and being adapted to control the gains of said at least two gain control amplifiers, respectively, depending on the resistances across the source-chain paths of said third and fourth field effect transistors; and means for selectively coupling to each of said third and fourth field effect transistors either one of DC bias voltages which are produced by said first and second field effect transistors in accordance with the type of said first and second composite signals to be decoded.

This invention can be more fully understood from the following detailed description when taken in conjunction with the accompanying drawings, in which.

As aforementioned, general tendency of field effect transistors is that the characteristics of their internal resistance Ron with respect the gate-source voltages Vgs differ considerably from one another. But field effect transistors formed in the same array exhibit very similar characteristics.

Figure 4:
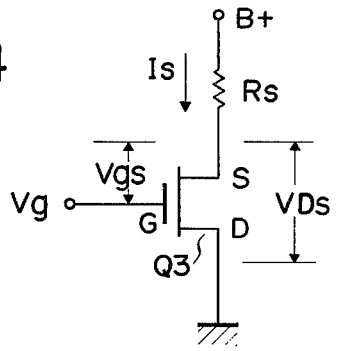
FIG. 4 is a circuit diagram for explaning a FET source-follower circuit.

If a P-channel enhancement type MOS field effect transistor $Q_3$ is connected in a source follower configuration as shown in FIG. 4, and a source resistor Rs has such a predetermined value as allow a source current Is to flow when a gate voltage Vg of the transistor $Q_3$ is constant, the ratio of the source-drain voltage $V_{DS}$ to the source current Is becomes substantially constant. In case a plurality of field effect transistors of the same type are used to constitute a plurality of circuits similar to that shown in FIG. 4, the ratio of $V_{DS}$ to Is is affected but little by the difference, if any, among the field effect transistors in pinch-off voltage Vp or threshold voltage $V_{TH}$, and it becomes substantially constant. The circuit as shown in FIG. 4 has characteristics such that the gate-source voltage Vgs varies in accordance with variation of the source current Is while the gate voltage Vg is constant, the internal resistance Ron of the field effect transistor is determined solely by source current Is, and the source-drain voltage $V_{DS}$ assumes a specific value corresponding to the value of source current Is. This is because the ratio of source-drain voltage $V_{DS}$ to source current Is in the source follower wherein gate-source voltage Vgs is not constant is determined mainly by a pattern of a field effect transistor in manufacturing the same, while the characteristic of the gate-source voltage Vgs of the field effect transistor, which relates to Vp or $V_{TH}$, largely depends on an impurity-diffusion process and so on in the manufacture of the semiconductor.

Accordingly if such a circuit as shown in FIG. 4 is employed as a reference circuit and if the gate-source voltage Vgs of the field effect transistor is applied to between the gate and source of another field effect transistor in the same array, the internal resistances Ron of these field effect transistors are set at substantially the same value. That is, if at least one of the field effect transistors in the same array is used as reference and the other transistors are used for control gain control amplifiers and if the source current Is of the reference transistor is made to have a predetermined value and the gate-source voltage Vgs of the reference transisitor is applied to the other control transistors, the gains of the gain control amplifiers can easily be set at a predetermined value.

Figure 1:
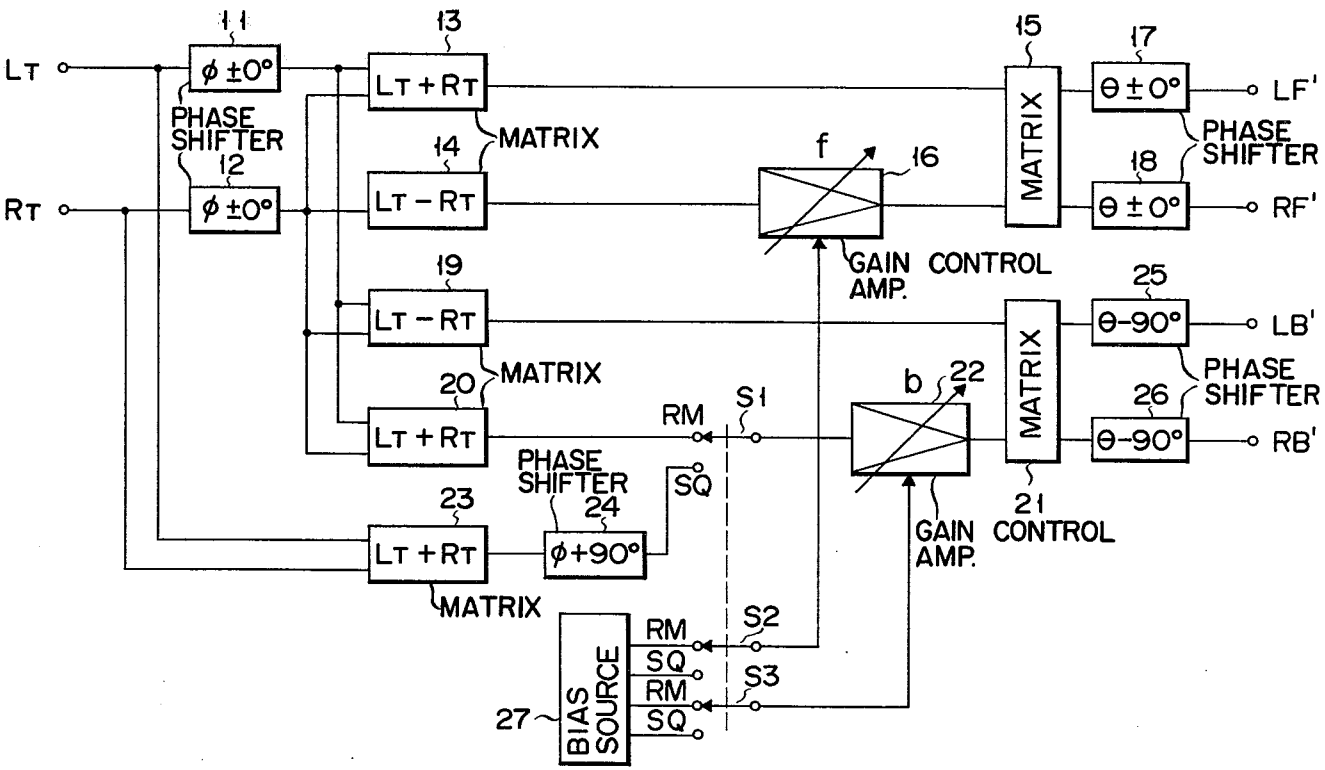
FIG. 1 PRIOR ART
FIG. 1 is a block diagram of a prior art decoder applicable to matrix 4-channel systems of different types.
Figure 2:
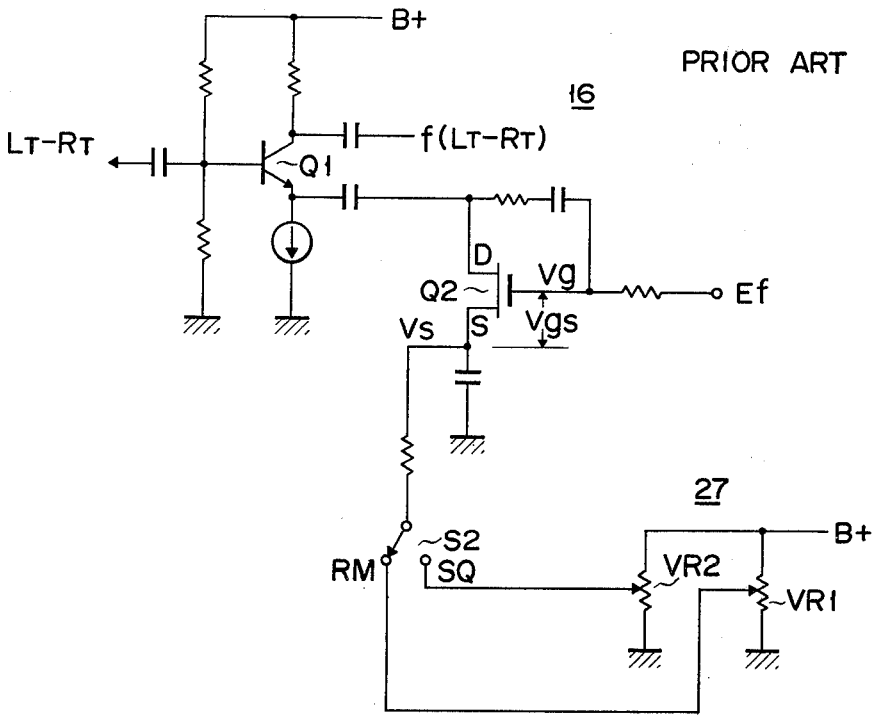
FIG. 2 is a circuit diagram of a prior art gain control amplifier in the decoder shown in FIG. 1.
Figure 3:
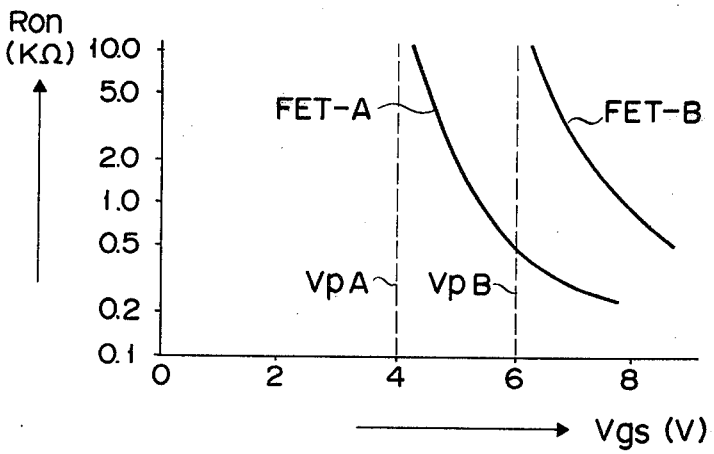
FIG. 3 is a diagram showing the difference between two field effect transistors of the same type in characteristic of internal resistance with respect to gate-source voltage Vgs.
Figure 5:
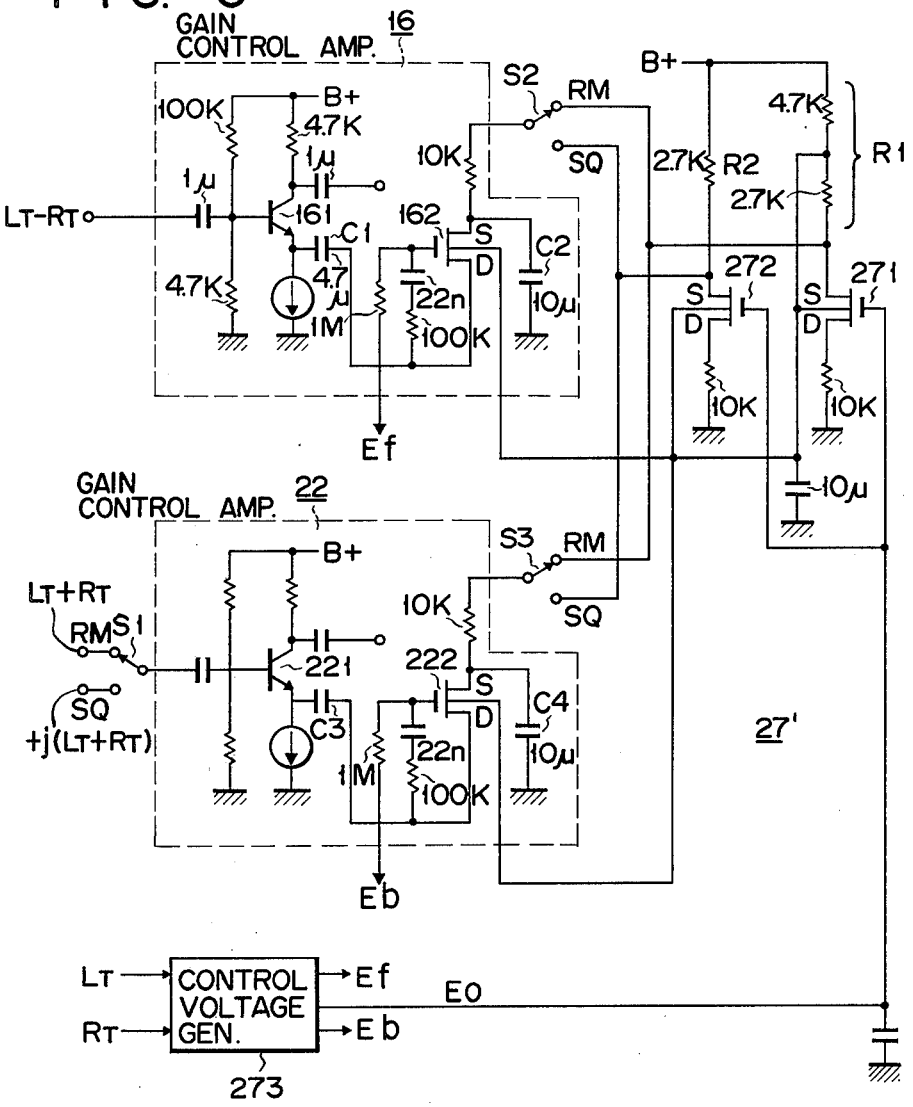
FIG. 5 shows a control circuit of the gain control amplifiers according to one embodiment of this invention.

In the decoder for various matrix 4-channel systems according to this invention, the gain control amplifier unit is constructed, for example, as illustrated in FIG. 5. The gain control amplifier unit includes two gain control amplifiers 16 and 22, the former constituted by a amplifying transistor 161 and another transistor 162 for controlling the gain of transistor 161, and the latter constituted by an amplifying transistor 221 and another transistor 222 for controlling the gain of transistor 221, both in substantially the same manner as illustrated in FIG. 2. The control transistors 162 and 222 are AC coupled respectively with the amplifying transistors 161 and 221 through capacitors C1, C2 and C3, C4 so that through their drain-source paths no DC current flows. In FIG. 5, 271 and 272 denote a reference field effect transistor for the RM(QS) system and a reference field effect transistor for the SQ system. The reference transistor 271 and 272 are formed in the same semiconductor chip together with the control transistors 162 and 222. The reference transistors 271 and 272 are applied at their gates with a gate voltage Eo from a control voltage generator 273 and connected in a source follower configuration so that predetermined source currents flow through which are determined by source resistors $R_1$ and $R_2$, respectively. The gate-source voltages of the reference transistors 271 and 272 are selectively applied to the control transistors 162 and 222 by switches $S_2$ and $S_3$. That is, the internal resistances of the control field effect transistors 162 and 222 have a value corresponding to the source current of the reference field effect transistor 271 which is determined by the resistor $R_1$ or to the source current of the reference field effect transistor 272 which is determined by the resistor $R_2$.

As a result, in decoder of such construction, if the values of the resistors $R_1$ and $R_2$ are selected at such values that source currents flow through both the reference transistors 271 and 272 to impart specific internal resistances to the transistors 271 and 272, the control transistors 162 and 222 of the gain control amplifiers 16 and 22 can have their internal resistances set at one of the specific values whereby the gains of the gain control amplifiers 16 and 22 may have a gain suitable for the decoding of the RM(QS) system or the SQ system. Further, if voltage Ef and voltage Eb to be applied from the control voltage generator 273 respectively to the gate of the control transistor 162 and that of the control transistor 222 have not a constant value corresponding to the gate voltage Eo of the reference transistors 271 and 272, but are varied in accordance with the instantaneous amplitude relationship between a plurality of audio signals in the composite signals $L_T$ and $R_T$, the gains of the gain control amplifiers 16 and 22 can be changed according to the variation of the voltages Ef and Eb, thereby enhancing the separation between channels. The control voltage generator 273 is adapted to generate a first control voltage Ef and a second control voltage Eb whose values vary in the opposite direction with respect to the reference voltage Eo in accordance with the phase relationship between the composite signals $L_T$ and $R_T$ or the amplitude relationship between the sum signal $L_T+R_T$ and the difference signal $L_T-R_T$. Suitable circuits for the control voltage generator are shown in U.S. Pat. No. 3,825,684, particularly FIGS. 5 and 8.

As mentioned above, the gain control amplifiers 16 and 22 can simultaneously have the same gain merely by presetting the values of the resistors $R_1$ and $R_2$ which determine the source currents of the reference transistors 271 and 272 for the RM(QS) system and the SQ system, respectively. For this reason, the gains of the gain control amplifiers 16 and 22 can be adjusted easily.

Figure 6A:
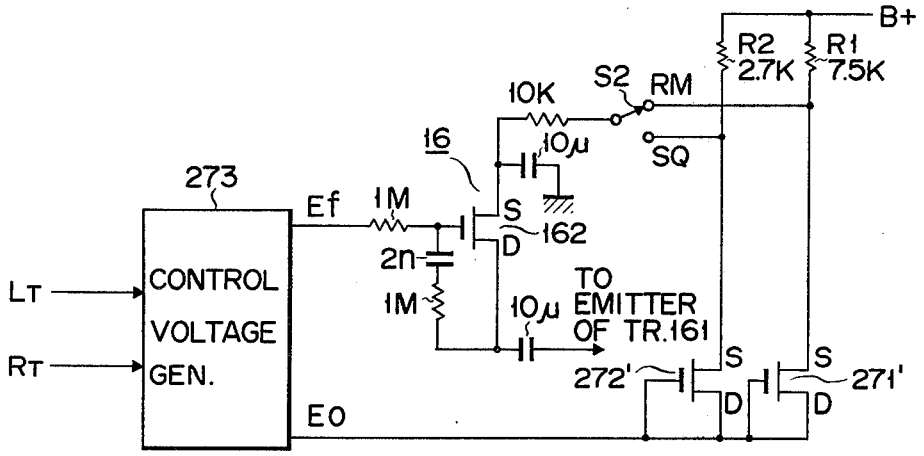
FIGS. 6A and 6B show the circuit diagrams of other embodiment of this invention.
Figure 6B:
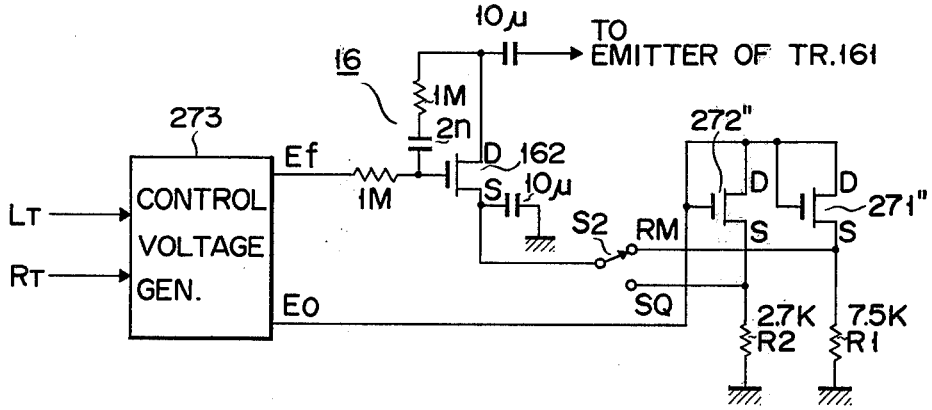

The present invention need not be limited to the embodiment illustrated in FIG. 5. For instance, P-channel reference field effect transistors 271′ and 272′ may be employed as shown in FIG. 6A, or N-channel reference field effect transistors 271″ and 272″ may be used as illustrated in FIG. 6B. In the embodiments of FIGS. 5, 6A and 6B, the gate-source voltage of a reference field effect transistor is applied as bias voltage to a gain control field effect transistor. The gate-drain voltage of the reference transistor may instead be applied to the gain control transistor, achieving the same effects as in the above embodiments.

The present invention is applicable to a decoder apparatus which comprises four gain control amplifiers.

What is claimed is:

1. A decoder apparatus applicable to matrix 4-channel systems of different types and adapted to produce 4-channel output signals by combining first and second composite signals to be decoded, said decoder apparatus comprising:

at least two gain control amplifiers each adapted to vary amplitude ratio between signals to be combined to produce output signal in accordance with the type of said first and second composite signals to be decoded; and control circuit means for controlling the gains of said at least two gain control amplifiers in accordance with the type of said first and second composite signals to be decoded, characterized in that said control circuit means comprises an FET array comprised of at least first, second, third and fourth field effect transistors formed in a semiconductor chip, the source-drain paths of said first and second field effect transistors being coupled across a DC power source so that predetermined direct currents of different values flow through the source-drain paths of said first and second field effect transistors, and the source-drain paths of said third and fourth field effect transistors being AC coupled to said at least two gain control amplifiers, respectively, so that no direct current flows from said gain control amplifiers through the source-drain paths of said third and fourth field effect transistors and being adapted to control the gains of said at least two gain control amplifiers, respectively, depending on the resistances across the source-drain paths of said third and fourth field effect transistors; and means for selectively coupling to each of said third and fourth field effect transistors either one of DC bias voltages which are produced by said first and second field effect transistors in accordance with the type of said first and second composite signals to be decoded.

2. A decoder apparatus according to claim 1 wherein said control circuit means comprises control voltage generating means responsive to an instantaneous amplitude relationship between audio signals in said first and second composite signals to be decoded for producing at least first and second control voltage signals the magnitude of which varies relative to a reference voltage, the gate electrodes of said first and second field effect transistors are connected to receive the reference voltage, and the gate electrodes of said third and fourth field effect transistors are connected to receive the first and second control voltage signals, respectively.

3. A decoder apparatus according to claim 1, wherein said first to fourth field effect transistors are MOS field effect transistors.

* * * * *